United States Patent [19]

Humphrey

[11] 4,449,708

[45] May 22, 1984

[54] GOLF PRACTICE DEVICE

[76] Inventor: Michael N. R. Humphrey, 39 Princes Rd., Kingswood, S.A. 5062, Australia

[21] Appl. No.: 409,109

[22] Filed: Aug. 18, 1982

[30] Foreign Application Priority Data

Aug. 21, 1981 [AU] Australia ..... PF0375

[51] Int. Cl.[3] ..... A63B 69/36

[52] U.S. Cl. ..... 273/186 A; 273/191 A; 273/191 B; 273/35 A; 273/171

[58] Field of Search ..... 273/191 R, 191 A, 191 B, 273/35 A, 186 R, 186 A, 186 C, 192

[56] References Cited

U.S. PATENT DOCUMENTS

| | | | |
|---|---|---|---|
| 1,410,811 | 3/1922 | Lewis | 273/35 A |
| 1,567,530 | 12/1925 | MacNaughton et al. | 273/191 A |
| 3,703,294 | 11/1972 | Fitch | 273/191 B |
| 4,034,991 | 7/1977 | Oppenheimer | 273/191 B X |
| 4,334,684 | 6/1982 | Sterling | 273/192 |

FOREIGN PATENT DOCUMENTS

| | | | |
|---|---|---|---|
| 522814 | 6/1940 | United Kingdom | 273/191 R |
| 1174773 | 12/1969 | United Kingdom | 273/191 A |

*Primary Examiner*—George J. Marlo
*Attorney, Agent, or Firm*—Jay L. Chaskin

[57] ABSTRACT

A golf practice device comprising a track secured to a fixed mounting surface, such as a wall, post or the like; a carriage guided for movement along the track and a flexible tension member connecting the carriage to the shaft of a golf club. The tension member is adjustable for length. The golf club is guided in a path of movement which lies generally in a plane parallel to the plane of the track. The track is of a smaller dimension and similar in shape to the path of movement.

19 Claims, 5 Drawing Figures

GOLF PRACTICE DEVICE

This invention relates to a device which is useful for practising the game of golf and certain other games.

BACKGROUND OF THE INVENTION

The main difficulty encountered by golfers is the development of a swing that will not vary during play because the various muscular movements required are so pattern coordinated through practice that the whole movement (swing) becomes comfortably simple and natural, (much as walking becomes a simple natural movement after it has been learned and practiced). It has been previously believed that a golf club should be swung in an arc which is substantially planar, although the radius of the arc may vary from beginning to end of swing. I have determined that it is more important that the arc should retain its relationship to the so-called "plane" of the swing, than that the radius should remain unchanged, and my studies have indicated that there is some advantage in allowing the radius of curvature of golf club swing to both increase and decrease during the club swing, especially as the club nears the end of its swing, and further, that there should be some deviation from a geometric planar movement. This pattern of movement should be consistent with the user's body muscular limitations to achieve the required maximum power and efficiency.

Various devices have been proposed heretofore which are useful in restricting and guiding the movement of a golf club when swung, but some of the previously proposed devices have made use of ancillary equipment attached to a golf club shaft, or harnesses strapped to the body. These devices interfere considerably with the smooth rhythmic flow of body and club movement and thus detract from the body's senses, and the all important "feel" of the golf swing so vital to the golfer when actually producing the swing when not attached to these devices. In fact the body senses set up a familiarity of acceptance to these interferences to the "feel", so that when the golfer is detached from any of these devices and thus this interference is removed, the body's natural senses become confused and become interferences in themselves by causing change of "feel" and thus a feeling of awkwardness or disharmony during the swing. The result is the golfer is left trying to repeat the swing in conditions alien to those experienced during practise while attached to these devices. It will be appreciated by golfers that they become very finely attuned to different clubs, and the main object of this invention is to provide a golf practice device wherein there is a minimum of interference with the "feel".

Another problem in providing a practice device which is suitable for use by different players is that some players move their clubs in patterns approximating planes inclined to the vertical by a greater amount than the planes in which other players move their clubs, and an object of this invention is to provide means whereby this change of plane can be accommodated.

BRIEF SUMMARY OF THE INVENTION

In this invention there is provided a track to be secured to a mounting surface (wall, post or the like), a carriage guided for movement along the track, and a tension member connecting the carriage to the shaft of a golf club. The tension member is adjustable for length.

The tension member may be a flexible member, whereby there is no restraint on the angle of inclination of the arc in which the golf club swings. The track can be secured to lie generally in a plane which varies from a vertical plane by an amount which may be selected.

More specifically in one embodiment a golf practice device consists of a track, means for securing the track to a mounting surface, a carriage movable along and guided by the track, a tension member secured at one end to the carriage and having securing means at its other end for securing the tension member to a shaft of a golf club, and length adjustment means on the tension member by which the distance between the head of the golf club and the carriage is adjustable.

BRIEF SUMMARY OF THE DRAWINGS

An embodiment of the invention is described hereunder in some detail with reference to and is illustrated in the accompanying drawings in which.

DETAILED DESCRIPTION OF THE PREFERRED EMBODIMENT

Figure 1:
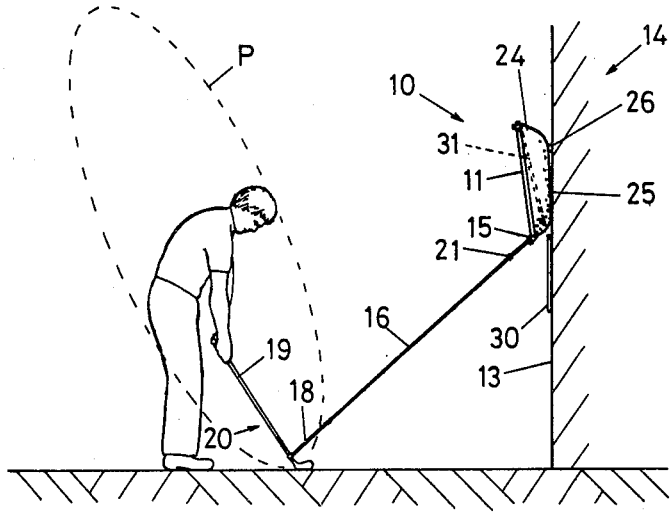
FIG. 1 is a side elevation which illustrates the manner in which the golf practice device is used.

In the embodiment illustrated a golf practice device 10 comprises a track 11, screws 12 securing the track 11 to a mounting surface 13 of the wall 14, a sliding carriage 15 which is slidable along and guided by the track 11, a tension member 16 which is secured at the upper end to the sliding carriage 15 and which has a loop 18 at its lower end which constitutes securing means for securing the tension member 16 to the shaft 19 of the golf club 20. The tension member 16 is a cord which is provided with an adjustment locking device 21 which, in use, effectively adjusts the length of the tension member 16 between the head of the golf club 20 and the carriage and also alters the plane of the swing, together with the angle of the device. Adjustable stops 17 on the ends of track 11 provide means for controlling the length of travel of carriage 15, and thereby the lengths of both back-swing and follow-through.

Figure 2:
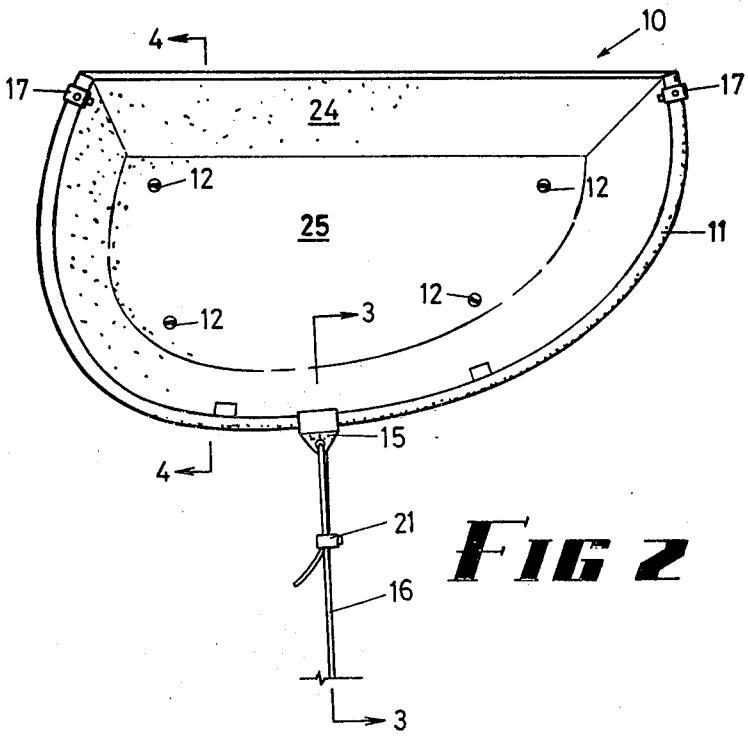
FIG. 2 is a front elevation of the device.
Figure 4:
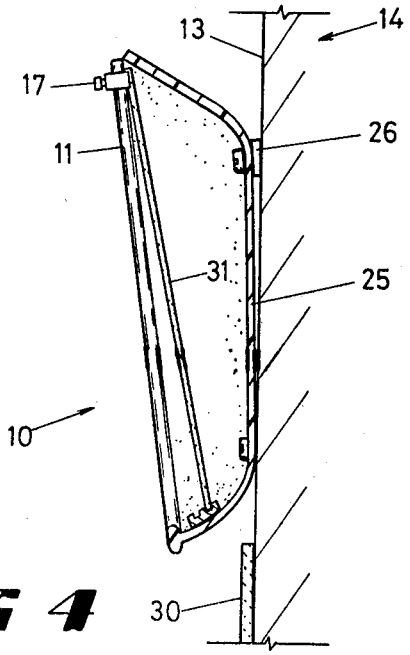
FIG. 4 is a section taken on line 4—4 of FIG. 2 but showing in addition a mirror.

As shown in FIGS. 1, 2 and 4, a dish-like member 24 has the track 11 defining part of its peripheral edge, the dish-like member 24 having a base 25 which is secured to the mounting surface 13 by the screws 12, but since the plane "P" adjacent to which one player swings his golf club may be different from that adjacent to which another player swings his golf club, use is made of spacing packers 26 through which the upper screws 12 pass, and the lengths of these packers are adjusted so that the plane of the track 11 (which varies slightly from being planar) is nearly parallel to the plane "P" through which the golfer wishes to swing his club.

The mounting surface 13 is provided with a lower mirror 30, and an upper mirror 31 (shown only in FIG. 4) is secured to the base 25 of the dish-like member 24 to assist a golfer to observe his muscle movement during his golf swing.

Figure 3:
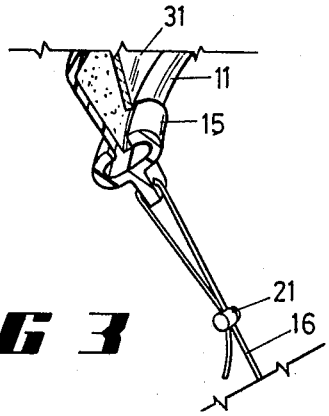
FIG. 3 is an enlarged section taken on line 3—3 of FIG. 2.

As seen best in FIG. 3, the track 11 is of general elliptical shape in cross section, and this is slidably engaged by the complementary carriage 15. Although various materials may be used, one suitable selection is ABS for the dish-like member 24 and PTFE for the sliding carriage 15. In another embodiment the sliding carriage 15 is replaced by a wheeled trolley.

The tension member 16 is shown in simplest form as a flexible cord interconnecting the club shaft 19 to the carriage 15. By remaining in a straight line and under slight tension, the tension member 16 will ensure that the club head moves in a path which is approximately in plane "P" and which is approximately an enlarged replica of the track 11. FIG. 2 illustrates the required shape. The angle of the track is so arranged that the track and track follower carriage are always facing directly in a straight line along the tension member to the attachment point of the club. This ensures free movement along the track by the track follower carriage.

Figure 5:
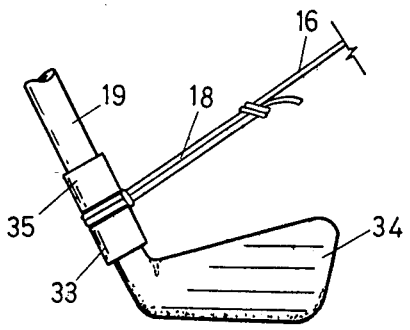
FIG. 5 is a front elevation showing one way of attaching a tension member to the shaft of a golf club.

To strengthen and exercise the golfer's muscles and increase his power and club head speed, a small lead weight 33 is positioned around the bottom of the shaft 19 near the head 34 of the golf club 20, and the cord retained by tape 35 as seen best in FIG. 5.

The above embodiment is very useful for training a golfer. However, there are instances in which there are required further modifications. In a second embodiment not herein illustrated, there is provided a base plate, for example a flat board, with mounting means on its rear face securing it to a support post or wall. The front face of the board has a plurality of screw threaded fasteners by which the track holder is secured, in this embodiment being of I section polymeric material. The fasteners however embody or constitute adjustment means in two planes, one at right angles to the face of the plate and one parallel thereto. The track can therefore vary in its distance from the face, as well as in its angle and shape. A small four wheel trolley (track following carriage) engages the outer flange of the track, and the tension member is secured at one end to this trolley. This embodiment allows the user to arrange the complete track shape and plane to meet his requirements, adjusting if and where necessary. Surprisingly, the club head will be found to follow the track shape, in its swing, but of course enlarged. This provides means for a player to achieve accurate repetition and also to mould his swing to any shape or plane, or that of an expert golfer.

The connectors on the ends of the tension member can be of the ball-and-socket type, or flexible cable type, as required. Electronic or electrical means (for example a capacitance detector) can be used to identify too much or too little tension on the tension member, and an electronic timer can be adjusted to identify time lapse, for example between the top of back-swing and ball impact, also to audibly signal the top of back-swing and moment of impact.

The invention can be used to enable disabled people (partially blind or paraplegics) to learn and master the muscle pattern movements required to perform well in the game.

Surprisingly, once a golfer using these apparatus has set the apparatus to suit his own particular body capabilities and practised on the apparatus, the body's muscle pattern and sensory system completely accepts the approximate plane and shape of the swing set on the apparatus. At that stage, the guiding control of the apparatus seems to completely disappear and no interference is experienced at all. Once this stage of practice is achieved the golfer starts to acquire the "feel" of the swing and becomes able to repeat the swing when detached from the apparatus. Another benefit of the apparatus is that because of its portability the user can position it in any suitable location and as long as the setting remains the same, he will be able to practice the same muscle pattern and "feel" required.

As said, the device has been found to be effective in developing a sound swing in shape and plane. However further benefits are derived with practice from the apparatus. Because the user is confined to the set arc and plane, which develops the muscle and sensory pattern used in this swing, the user develops a good flowing rhythm and once this occurs a good balance develops allowing the golfer to deploy maximum power of his developed muscle pattern to the best of his ability. Also by adjusting the track-stop 17 he can adjust the top of his back-swing to suit his muscle capability and improve his power control on his down-swing. This stopper gives an audible "click" when the track follower carriage contacts it and the muscle sensory pattern absorbs the message as does the audible sensory system and the combination of these senses produce a "feel" situation acceptable subconciously to the golfer that the back-swing is completed and the down-swing muscle pattern then triggers automatically. This is an area that has always created difficulty in a good golf swing.

Various modifications in structure and/or function may be made by one skilled in the art to the disclosed embodiments without departing from the scope of the invention as defined by the claims.

What is claimed is:

1. A golf practice device to be used with and for guiding a golf club in a path of movement which lies generally in a first plane and deviates only slightly from that first plane, comprising a track, means for securing the track to a fixed stationary mounting surface, the track being smaller in dimension and similar in shape to the path of movement and lying generally in a second plane parallel to but spaced from the first plane;

a carriage movable along and guided by the track;

a flexible tension member;

first means for securing one end of the tension member to the carriage and having second securing means for securing the other end of the tension member to a shaft of the golf club, and length adjustment means on the tension member by which the distance between a head of the golf club and the carriage is adjustable.

2. A golf practice device according to claim 1 comprising means for adjusting the angle of the second plane.

3. A golf practice device according to claim 2 wherein the plane adjusting means comprises spacers between the track securing means and the mounting surface.

4. A golf practice device according to claim 1 further comprising stops on the ends of the track, and adjustment means on the stops for adjusting their respective positions on the track.

5. A golf practice device according to claim 1 further comprising a mirror.

6. A golf practice device according to claim 1 further comprising a weight attachable to the shaft of the golf club near the club head.

7. A golf practice device according to claim 1 wherein said tension member is a flexible cord.

8. A golf practice device according to claim 7 wherein said tension member securing means comprises a loop in the end of the flexible cord.

9. A golf practive device to be used with and for guiding a golf club head in a path of movement which lies generally in a plane and deviates only slightly from that plane, comprising a member having a base and a peripheral edge forming a track of smaller dimension but similar shape to the path of movement and lying in a second plane parallel to but spaced from the first plane;

means securing the base to a mounting surface;

a carriage movable along the track;

a flexible tension member having means for securing one end thereof to the carriage and having further securing means at its other end for securing the tension member to a shaft of the golf club; and length adjustment means on the tension member by which the distance between the head of the golf club and the carriage is adjustable.

10. A golf practice device according to claim 9 wherein the tension member is a flexible cord.

11. A golf practice device according to claim 9 wherein the tension member securing means comprises a loop in the end of the flexible member.

12. A golf practice device according to claim 9 further comprising spacers between the base of the member and the mounting surface.

13. A golf practice device according to claim 9 further comprising stops on the ends of the track, and adjustment means on the stops for adjusting their respective positions on the track.

14. A golf practice device according to claim 9 further comprising a mirror carried by the member.

15. A golf practice device according to claim 9 comprising a weight attachable to the shaft of the golf club near the club head, the further securing means securing the other end of the tension member to the weight.

16. A method of practicing a golf club swing comprising the steps of:

providing a carriage movable on a curvilinear track secured to a fixed and stationary surface, the track lying in a first plane and the carriage traversing a desired path of movement in the first plane for the golf club;

attaching one end of a flexible tension member to the carriage and the other end to the shaft of the golf club near the head thereof; and swinging the golf club while retaining the tension member under tension through a second plane generally parallel to and spaced from the first plane, the golf club path of movement thereby approximating the desired path of movement.

17. A method of practicing a golf club swing according to claim 16 comprising the step of varying the inclination of the first plane.

18. A method of practicing a golf club swing according to claim 16 comprising the step of adjusting the length of the desired path of movement by locating stops at each end of the traverse of the carriage on the track.

19. A method of practicing a golf club swing according to claim 16 comprising the step of positioning a weight on the shaft near the head of the club.

* * * * *